US009672766B2

(12) United States Patent
Sjodin

(10) Patent No.: US 9,672,766 B2
(45) Date of Patent: Jun. 6, 2017

(54) METHODS FOR DRIVING ELECTRO-OPTIC DISPLAYS

(75) Inventor: Theodore A. Sjodin, Waltham, MA (US)

(73) Assignee: E Ink Corporation, Billerica, MA (US)

( * ) Notice: Subject to any disclaimer, the term of this patent is extended or adjusted under 35 U.S.C. 154(b) by 1724 days.

(21) Appl. No.: 12/423,211

(22) Filed: Apr. 14, 2009

(65) Prior Publication Data

US 2009/0195568 A1 Aug. 6, 2009

Related U.S. Application Data

(60) Continuation-in-part of application No. 11/425,408, filed on Jun. 21, 2006, now Pat. No. 7,733,311, which is a division of application No. 10/814,205, filed on Mar. 31, 2004, now Pat. No. 7,119,772.

(60) Provisional application No. 61/044,584, filed on Apr. 14, 2008, provisional application No. 60/320,070, filed on Mar. 31, 2003, provisional application No. 60/320,207, filed on May 5, 2003, provisional application No. 60/481,669, filed on Nov. 19, 2003, provisional application No. 60/481,675, filed on Nov. 20, 2003, provisional application No. 60/557,094, filed on Mar. 26, 2004.

(51) Int. Cl.
*G09G 3/20* (2006.01)
*G09G 3/34* (2006.01)

(52) U.S. Cl.
CPC ..... *G09G 3/2011* (2013.01); *G09G 3/344* (2013.01); *G09G 2320/0204* (2013.01); *G09G 2320/0285* (2013.01)

(58) Field of Classification Search
USPC ..... 345/87, 88, 89, 107; 359/296
See application file for complete search history.

(56) References Cited

U.S. PATENT DOCUMENTS

| | | | |
|---|---|---|---|
| 4,418,346 | A | 11/1983 | Batchelder |
| 5,760,761 | A | 6/1998 | Sheridon |
| 5,777,782 | A | 7/1998 | Sheridon |
| 5,808,783 | A | 9/1998 | Crowley |
| 5,872,552 | A | 2/1999 | Gordon, II et al. |
| 5,930,026 | A | 7/1999 | Jacobson et al. |
| 6,054,071 | A | 4/2000 | Mikkelsen, Jr. |

(Continued)

FOREIGN PATENT DOCUMENTS

| | | |
|---|---|---|
| EP | 1462847 | 9/2004 |
| EP | 1482354 | 12/2004 |

(Continued)

OTHER PUBLICATIONS

Wood, D., "An Electrochromic Renaissance?" Information Display, 18(3), 24 Mar. 1, 2002.

(Continued)

*Primary Examiner* — Nicholas Lee
(74) *Attorney, Agent, or Firm* — David J. Cole

(57) ABSTRACT

A bistable electro-optic display having a plurality of pixels each of which is capable of displaying at least three optical states, including two extreme optical states, is driven by the method comprising a first drive scheme capable of effecting transitions between all of the gray levels which can be displayed by the pixels; and a second drive scheme which contains only transitions ending at one of the extreme optical states of the pixels.

16 Claims, 7 Drawing Sheets

(56) References Cited

U.S. PATENT DOCUMENTS

| | | | | |
|---|---|---|---|---|
| 6,055,091 | A | 4/2000 | Sheridon et al. | |
| 6,097,531 | A | 8/2000 | Sheridon | |
| 6,128,124 | A | 10/2000 | Silverman | |
| 6,130,774 | A | 10/2000 | Albert et al. | |
| 6,137,467 | A | 10/2000 | Sheridon et al. | |
| 6,144,361 | A | 11/2000 | Gordon, II et al. | |
| 6,147,791 | A | 11/2000 | Sheridon | |
| 6,172,798 | B1 | 1/2001 | Albert et al. | |
| 6,184,856 | B1 | 2/2001 | Gordon, II et al. | |
| 6,225,971 | B1 | 5/2001 | Gordon, II et al. | |
| 6,241,921 | B1 | 6/2001 | Jacobson et al. | |
| 6,271,823 | B1 | 8/2001 | Gordon, II et al. | |
| 6,301,038 | B1 | 10/2001 | Fitzmaurice et al. | |
| 6,445,489 | B1 | 9/2002 | Jacobson et al. | |
| 6,473,072 | B1 * | 10/2002 | Comiskey et al. | 345/173 |
| 6,504,524 | B1 | 1/2003 | Gates et al. | |
| 6,512,354 | B2 | 1/2003 | Jacobson et al. | |
| 6,531,997 | B1 | 3/2003 | Gates et al. | |
| 6,753,999 | B2 | 6/2004 | Zehner et al. | |
| 6,788,449 | B2 | 9/2004 | Liang et al. | |
| 6,825,970 | B2 | 11/2004 | Goenaga et al. | |
| 6,866,760 | B2 | 3/2005 | Paolini Jr. et al. | |
| 6,870,657 | B1 | 3/2005 | Fitzmaurice et al. | |
| 6,900,851 | B2 | 5/2005 | Morrison et al. | |
| 6,922,276 | B2 | 7/2005 | Zhang et al. | |
| 6,950,220 | B2 | 9/2005 | Abramson et al. | |
| 6,982,178 | B2 | 1/2006 | LeCain | |
| 6,995,550 | B2 | 2/2006 | Jacobson et al. | |
| 7,002,728 | B2 | 2/2006 | Pullen et al. | |
| 7,012,600 | B2 | 3/2006 | Zehner et al. | |
| 7,023,420 | B2 * | 4/2006 | Comiskey et al. | 345/107 |
| 7,034,783 | B2 | 4/2006 | Gates et al. | |
| 7,075,502 | B1 | 7/2006 | Drzaic et al. | |
| 7,116,318 | B2 | 10/2006 | Amundson et al. | |
| 7,116,466 | B2 | 10/2006 | Whitesides et al. | |
| 7,119,772 | B2 | 10/2006 | Amundson et al. | |
| 7,170,670 | B2 | 1/2007 | Webber | |
| 7,193,625 | B2 | 3/2007 | Danner et al. | |
| 7,202,847 | B2 | 4/2007 | Gates | |
| 7,236,291 | B2 | 6/2007 | Kaga et al. | |
| 7,259,744 | B2 | 8/2007 | Arango et al. | |
| 7,304,787 | B2 | 12/2007 | Whitesides et al. | |
| 7,312,784 | B2 | 12/2007 | Baucom et al. | |
| 7,312,794 | B2 | 12/2007 | Zehner et al. | |
| 7,327,511 | B2 | 2/2008 | Whitesides et al. | |
| 7,411,719 | B2 | 8/2008 | Paolini, Jr. et al. | |
| 7,420,549 | B2 | 9/2008 | Jacobson et al. | |
| 7,453,445 | B2 | 11/2008 | Amundson | |
| 7,492,339 | B2 | 2/2009 | Amundson | |
| 7,525,719 | B2 | 4/2009 | Yakushiji et al. | |
| 7,528,822 | B2 | 5/2009 | Amundson et al. | |
| 7,535,624 | B2 | 5/2009 | Amundson | |
| 7,545,358 | B2 | 6/2009 | Gates et al. | |
| 7,583,251 | B2 | 9/2009 | Arango et al. | |
| 7,602,374 | B2 | 10/2009 | Zehner et al. | |
| 7,612,760 | B2 | 11/2009 | Kawai | |
| 7,679,599 | B2 | 3/2010 | Kawai | |
| 7,679,814 | B2 | 3/2010 | Paolini, Jr. et al. | |
| 7,688,297 | B2 | 3/2010 | Zehner et al. | |
| 7,729,039 | B2 | 6/2010 | LeCain et al. | |
| 7,733,311 | B2 | 6/2010 | Amundson et al. | |
| 7,733,335 | B2 | 6/2010 | Zehner et al. | |
| 7,787,169 | B2 | 8/2010 | Abramson et al. | |
| 7,839,564 | B2 | 11/2010 | Whitesides et al. | |
| 7,952,557 | B2 | 5/2011 | Amundson et al. | |
| 7,999,787 | B2 | 8/2011 | Amundson et al. | |
| 8,009,348 | B2 | 8/2011 | Zehner et al. | |
| 8,125,501 | B2 | 2/2012 | Amundson et al. | |
| 8,139,050 | B2 | 3/2012 | Jacobson et al. | |
| 8,169,400 | B2 | 5/2012 | Shih | |
| 8,174,490 | B2 | 5/2012 | Whitesides et al. | |
| 8,289,250 | B2 | 10/2012 | Zehner et al. | |
| 8,300,006 | B2 | 10/2012 | Zhou et al. | |
| 8,384,658 | B2 | 2/2013 | Albert et al. | |
| 8,558,783 | B2 | 10/2013 | Wilcox et al. | |
| 8,928,562 | B2 | 1/2015 | Gates et al. | |
| 2002/0109661 | A1 * | 8/2002 | Blackson et al. | 345/97 |
| 2003/0102858 | A1 | 6/2003 | Jacobson et al. | |
| 2005/0253777 | A1 | 11/2005 | Zehner et al. | |
| 2006/0087479 | A1 | 4/2006 | Sakurai | |
| 2007/0091418 | A1 | 4/2007 | Danner et al. | |
| 2007/0103427 | A1 | 5/2007 | Zhou et al. | |
| 2007/0139358 | A1 | 6/2007 | Sakamoto | |
| 2007/0146306 | A1 | 6/2007 | Johnson et al. | |
| 2008/0024429 | A1 | 1/2008 | Zehner | |
| 2008/0024482 | A1 | 1/2008 | Gates et al. | |
| 2008/0136774 | A1 | 6/2008 | Harris et al. | |
| 2008/0266243 | A1 | 10/2008 | Johnson et al. | |

FOREIGN PATENT DOCUMENTS

| | | |
|---|---|---|
| EP | 1484635 | 12/2004 |
| EP | 1500971 A1 | 1/2005 |
| EP | 1501194 | 1/2005 |
| EP | 1536271 | 6/2005 |
| EP | 1542067 | 6/2005 |
| EP | 1577702 | 9/2005 |
| EP | 1577703 | 9/2005 |
| EP | 1598694 | 11/2005 |
| JP | 6064395 | 4/1985 |
| WO | WO2004079442 | 9/2004 |
| WO | WO0201281 | 11/2010 |

OTHER PUBLICATIONS

O'Regan, B. et al., "A Low Cost, High-efficiency Solar Cell Based on Dye-sensitized colloidal TiO2 Films", Nature, vol. 353, Oct. 24, 1991, 773-740 Oct. 24, 1991.

Bach, U., et al., "Nanomaterials-Based Electrochromics for Paper-Quality Displays", Adv. Mater, 14(11), 845 Jun. 5, 2002.

Hayes, R.A., et al., "Video-Speed Electronic Paper Based on Electrowetting", Nature, vol. 425, pp. 383-385 Sep. 25, 2003.

Kitamura, T., et al., "Electrical toner movement for electronic paper-like display", Asia Display/IDW '01, p. 1517, Paper HCS1-1 Dec. 31, 2001.

Yamaguchi, Y., et al., "Toner display using insulative particles charged triboelectrically", Asia Display/IDW '01, p. 1729, Paper AMD4-4 Dec. 31, 2001.

International Search Report and Written Opinion for corresponding PCT/US2009/040473 Feb. 25, 2010.

* cited by examiner

METHODS FOR DRIVING ELECTRO-OPTIC DISPLAYS

REFERENCE TO RELATED APPLICATIONS

This application claims benefit of Application Ser. No. 61/044,584, filed Apr. 14, 2008. This application is also a continuation-in-part of application Ser. No. 11/425,408, filed Jun. 21, 2006 (Publication No. 2006/0232531, now U.S. Pat. No. 7,733,311), which itself is a divisional of application Ser. No. 10/814,205, filed Mar. 31, 2004 (now U.S. Pat. No. 7,119,772), which claims benefit of (i) Application Ser. No. 60/320,070, filed Mar. 31, 2003; (ii) Application Ser. No. 60/320,207, filed May 5, 2003; (iii) Application Ser. No. 60/481,669, filed Nov. 19, 2003; (iv) Application Ser. No. 60/481,675, filed Nov. 20, 2003; and (v) Application Ser. No. 60/557,094, filed Mar. 26, 2004.

This application is related to:

(a) U.S. Pat. No. 6,504,524;
(b) U.S. Pat. No. 6,512,354;
(c) U.S. Pat. No. 6,531,997;
(d) U.S. Pat. No. 6,995,550;
(e) U.S. Pat. Nos. 7,012,600 and 7,312,794, and the related Patent Publications Nos. 2006/0139310 and 2006/0139311;
(f) U.S. Pat. No. 7,034,783;
(g) U.S. Pat. No. 7,193,625;
(h) U.S. Pat. No. 7,259,744;
(i) U.S. Patent Publication No. 2005/0024353;
(j) U.S. Patent Publication No. 2005/0179642;
(k) U.S. Pat. No. 7,492,339;
(l) U.S. Pat. No. 7,327,511;
(m) U.S. Patent Publication No. 2005/0152018;
(n) U.S. Patent Publication No. 2005/0280626;
(o) U.S. Patent Publication No. 2006/0038772;
(p) U.S. Pat. No. 7,453,445;
(q) U.S. Patent Publication No. 2008/0024482;
(r) U.S. Patent Publication No. 2008/0048969; and
(s) U.S. Patent Publication No. 2008/0129667.

The aforementioned patents and applications may hereinafter for convenience collectively be referred to as the "MEDEOD" (Methods for Driving Electro-Optic Displays) applications. The entire contents of these patents and copending applications, and of all other U.S. patents and published and copending applications mentioned below, are herein incorporated by reference.

BACKGROUND OF INVENTION

The present invention relates to methods for driving electro-optic displays, especially bistable electro-optic displays, and to apparatus for use in such methods. More specifically, this invention relates to driving methods which allow for rapid response of the display to user input. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the patents and published applications referred to below describe electrophoretic displays in which the extreme states are white and deep blue, so that an intermediate "gray state" would actually be pale blue. Indeed, as already mentioned the transition between the two extreme states may not be a color change at all.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed to applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

Another type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y, et al., "Toner display using insulative particles charged triboelectrically", IDW Japan, 2001, Paper AMD4-4). See also U.S. Patent Publication No. 2005/0001810; European Patent Applications 1,462,847; 1,482,354; 1,484,635; 1,500,971; 1,501,194; 1,536,271; 1,542,067; 1,577,702; 1,577,703; and 1,598,694; and International Applications WO 2004/090626; WO 2004/079442; and WO 2004/001498. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in the these patents and applications include:

(a) Electrophoretic particles, fluids and fluid additives; see for example U.S. Pat. No. 7,002,728 and U.S. Patent Application Publication No. 2007/0146310;

(b) Capsules, binders and encapsulation processes; see for example U.S. Pat. Nos. 6,922,276 and 7,411,719;

(c) Films and sub-assemblies containing electro-optic materials; see for example U.S. Pat. No. 6,982,178 and U.S. Patent Application Publication No. 2007/0109219;

(d) Backplanes, adhesive layers and other auxiliary layers and methods used in displays; see for example U.S. Pat. No. 7,116,318 and U.S. Patent Application Publication No. 2007/0035808;

(e) Color formation and color adjustment; see for example U.S. Pat. No. 7,075,502 and U.S. Patent Application Publication No. 2007/0109219;

(f) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; and 7,312,794; and U.S. Patent Applications Publication Nos. 2003/0102858; 2005/0024353; 2005/0062714; 2005/0122284; 2005/0152018; 2005/0179642; 2005/0212747; 2005/0253777; 2005/0280626; 2006/0038772; 2006/0139308; 2006/0139310; 2006/0139311; 2006/0181492; 2006/0181504; 2006/0197738; 2006/0232531; 2006/0262060; 2007/0013683; 2007/0091418; 2007/0103427; 2007/0200874; 2008/0024429; 2008/0024482; 2008/0048969; 2008/0054879; 2008/0117495; 2008/0129667; 2008/0136774; and 2008/0150888, and any other MEDEOD applications and patents mentioned above;

(g) Applications of displays; see for example U.S. Pat. No. 7,312,784 and U.S. Patent Application Publication No. 2006/0279527; and (h) Non-electrophoretic displays, as described in U.S. Pat. Nos. 6,241,921; 6,950,220; and 7,420,549.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; and other similar techniques.) Thus, the resulting display can be flexible. Further, because the display medium can be printed (using a variety of methods), the display itself can be made inexpensively.

A related type of electrophoretic display is a so-called "microcell electrophoretic display". In a microcell electrophoretic display, the charged particles and the suspending fluid are not encapsulated within microcapsules but instead are retained within a plurality of cavities formed within a carrier medium, typically a polymeric film. See, for example, International Application Publication No. WO 02/01281, and published US Application No. 2002/0075556, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346.

The bistable or multi-stable behavior of particle-based electrophoretic displays, and other electro-optic displays displaying similar behavior (such displays may hereinafter for convenience be referred to as "impulse driven displays"), is in marked contrast to that of conventional liquid crystal ("LC") displays. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

It might at first appear that the ideal method for addressing such an impulse-driven electro-optic display would be so-called "general grayscale image flow" in which a controller arranges each writing of an image so that each pixel transitions directly from its initial gray level to its final gray level. However, inevitably there is some error in writing images on an impulse-driven display. Some such errors encountered in practice include:

(a) Prior State Dependence; With at least some electro-optic media, the impulse required to switch a pixel to a new optical state depends not only on the current and desired optical state, but also on the previous optical states of the pixel.

(b) Dwell Time Dependence; With at least some electro-optic media, the impulse required to switch a pixel to a new optical state depends on the time that the pixel has spent in its various optical states. The precise nature of this dependence is not well understood, but in general, more impulse is required the longer the pixel has been in its current optical state.

(c) Temperature Dependence; The impulse required to switch a pixel to a new optical state depends heavily on temperature.

(d) Humidity Dependence; The impulse required to switch a pixel to a new optical state depends, with at least some types of electro-optic media, on the ambient humidity.

(e) Mechanical Uniformity; The impulse required to switch a pixel to a new optical state may be affected by mechanical variations in the display, for example variations in the thickness of an electro-optic medium or an associated lamination adhesive. Other types of mechanical non-uniformity may arise from inevitable variations between different manufacturing batches of medium, manufacturing tolerances and materials variations.

(f) Voltage Errors; The actual impulse applied to a pixel will inevitably differ slightly from that theoretically applied because of unavoidable slight errors in the voltages delivered by drivers.

General grayscale image flow suffers from an "accumulation of errors" phenomenon. For example, imagine that temperature dependence results in a 0.2 L* (where L* has the usual CIE definition:

$$L^*=116(R/R_0)^{1/3}-16,$$

where R is the reflectance and $R_0$ is a standard reflectance value) error in the positive direction on each transition. After fifty transitions, this error will accumulate to 10 L*. Perhaps more realistically, suppose that the average error on each transition, expressed in terms of the difference between the theoretical and the actual reflectance of the display is ±0.2 L*. After 100 successive transitions, the pixels will display an average deviation from their expected state of 2 L*; such deviations are apparent to the average observer on certain types of images.

This accumulation of errors phenomenon applies not only to errors due to temperature, but also to errors of all the types listed above. As described in the aforementioned U.S. Pat. No. 7,012,600, compensating for such errors is possible, but only to a limited degree of precision. For example, temperature errors can be compensated by using a temperature sensor and a lookup table, but the temperature sensor has a limited resolution and may read a temperature slightly different from that of the electro-optic medium. Similarly, prior state dependence can be compensated by storing the prior states and using a multi-dimensional transition matrix, but controller memory limits the number of states that can be recorded and the size of the transition matrix that can be stored, placing a limit on the precision of this type of compensation.

Thus, general grayscale image flow requires very precise control of applied impulse to give good results, and empirically it has been found that, in the present state of the technology of electro-optic displays, general grayscale image flow is infeasible in a commercial display.

Under some circumstances, it may be desirable for a single display to make use of multiple drive schemes. For example, a display capable of more than two gray levels may make use of a gray scale drive scheme ("GSDS") which can effect transitions between all possible gray levels, and a monochrome drive scheme {"MDS") which effects transitions only between two gray levels, the MDS providing quicker rewriting of the display that the GSDS. The MDS is used when all the pixels which are being changed during a rewriting of the display are effecting transitions only between the two gray levels used by the MDS. For example, the aforementioned U.S. Pat. No. 7,119,772 describes a display in the form of an electronic book or similar device capable of displaying gray scale images and also capable of displaying a monochrome dialogue box which permits a user to enter text relating to the displayed images. When the user is entering text, a rapid MDS is used for quick updating of the dialogue box, thus providing the user with rapid confirmation of the text being entered. On the other hand, when the entire gray scale image shown on the display is being changed, a slower GSDS is used.

More specifically, present electrophoretic displays have an update time of approximately 700-900 milliseconds in grayscale mode, and 200-300 milliseconds in monochrome mode. For updates of the display required by user input, it is desirable to have a fast update, especially for interactive applications, such as drawing on the display using a stylus and a touch sensor, typing on a keyboard, menu selection, and scrolling of text or a cursor. Prior at electrophoretic displays are thus limited in interactive applications. Accordingly, it is desirable to provide drive means and a corresponding driving method which provides a combination of drive schemes that allow a portion of the display (for example, the portion lying beneath the track of a stylus to be updated with a rapid drive scheme.

SUMMARY OF INVENTION

Accordingly, in one aspect this invention provides a method of driving a bistable electro-optic display having a plurality of pixels each of which is capable of displaying at least three optical states, including two extreme optical states, the method comprising:

driving the electro-optic display using a first drive scheme capable of effecting transitions between all of the gray levels which can be displayed by the pixels; and driving the electro-optic display using a second drive scheme which contains only transitions ending at one of the extreme optical states of the pixels.

This method of the present invention may hereinafter for convenience be called the "double drive scheme" or DDS method of the present invention. As will readily be apparent from the foregoing discussion, the second drive scheme in this method is intended to be invoked when the display is to accept input from a stylus, pen, keyboard, mouse or similar input device. The maximum transition time of the second drive scheme will be typically be substantially shorter than that of the first. The second drive scheme desirably comprises a "direct" drive scheme where the waveform for each (non-zero) transition of the second drive scheme is defined as the first impulse between the initial and final states as defined by the first drive scheme.

This invention extends to a display controller or display arranged to carry out the DDS method of the present invention. The second drive scheme may if desired be modified to include some transitions which do not end at one of the extreme optical states of the pixels.

The displays of the present invention may make use of any of the types of bistable electro-optic media described above. Thus, for example, the displays may use a rotating bichromal member or electrochromic material, or an electrophoretic material comprising a plurality of electrically charged particles disposed in a fluid and capable of moving through the fluid under the influence of an electric field. In such an electrophoretic material the electrically charged particles and the fluid are confined within a plurality of capsules or microcells. Alternatively, the electrically charged particles and the fluid may be present as a plurality of discrete droplets surrounded by a continuous phase comprising a polymeric material. The fluid may be liquid or gaseous. An electrophoretic medium may comprise a single type of electrophoretic in a dyed fluid, or two differing types of electrophoretic particles having differing electrophoretic mobilities in an undyed fluid.

The displays of the present invention may be used in any application in which prior art electro-optic displays have been used. Thus, for example, the present displays may be used in electronic book readers, portable computers, tablet computers, cellular telephones, smart cards, signs, watches, shelf labels and flash drives.

DETAILED DESCRIPTION

As already indicated, this invention provides a method of driving a multi-pixel bistable electro-optic display. This method uses a first drive scheme capable of effecting transitions between all of the gray levels which can be displayed by the pixels; and a second drive scheme which contains only transitions ending at one of the extreme optical states of the pixels. The second drive scheme is intended to allow for rapid response of the display to user input, for example the user "writing" with a stylus on a display which incorporates a touch screen; note that such a touch screen may lie in front of or behind the electro-optic medium from the perspective of the user.

A standard gray scale drive scheme, such as may be used as the first drive scheme in this method, has an update time that is two to three times the length of a "saturation pulse" where a saturation pulse is defined as the pulse having the duration required to apply an impulse that will drive the display from one extreme optical state ("optical rail") to the other (i.e. black to white or white to black). The second, fast drive scheme can have an update time identical to the length of the saturation pulse. The fast drive scheme may consist of a "direct" drive scheme where, for each transition, a constant voltage is applied for a period sufficient to apply the direct impulse between the initial and final states as defined by the standard gray scale drive scheme.

Figure 1:
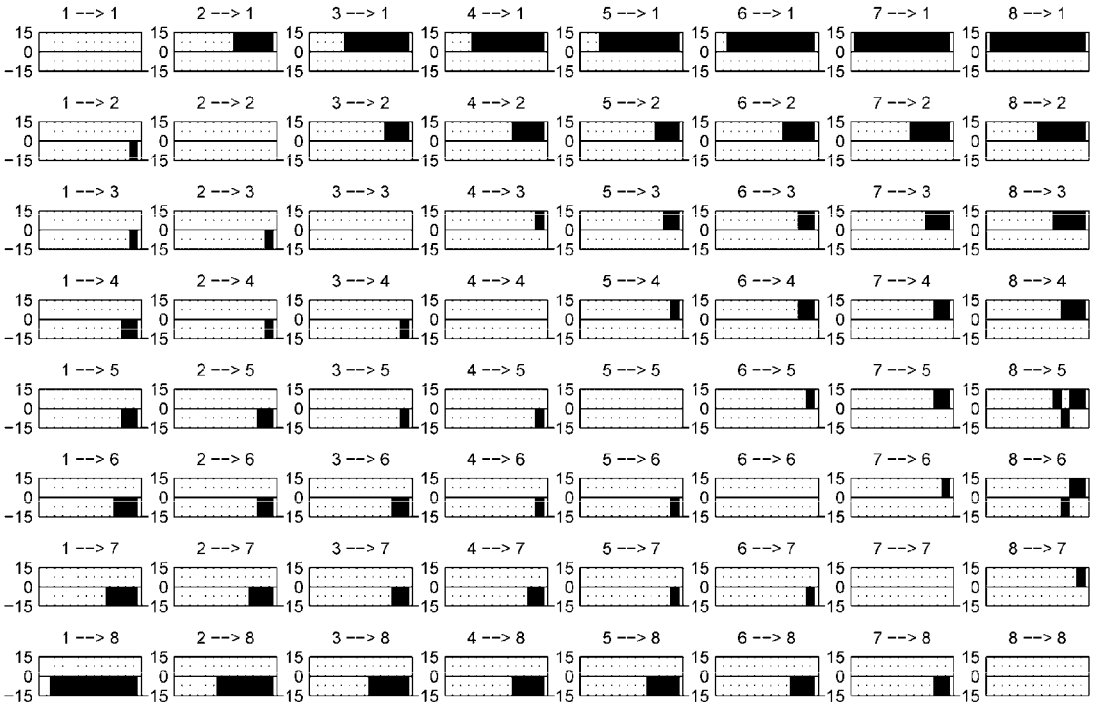
FIG. 1 illustrates a 3-bit (8 gray level) grayscale drive scheme which can be used in the method of the present invention.

However, it has been found that such a direct drive scheme produces large gray level errors (typically 3 to 10 L* units, where L* has the usual CIE definition) due the prior-state dependence of the electro-optic medium and other issues, as discussed in detail in the aforementioned MEDEOD applications. Adjusting the impulses for each waveform can reduce these errors. Adding find tuning of "FT" sequences as discussed in U.S. Patent Publication No. 2006/0232531, Paragraphs [0355] et seq. can further reduce the error. The length of such FT sequences should be shorter than the saturation pulse length plus the direct impulse length. The presently preferred drive schemes typically contain both adjusted impulse and FT sequences; an example is shown in FIG. 1 of the accompanying drawings. FIG. 1 shows a typical 3-bit (8 gray level) drive scheme. Each waveform is 13 frames long, and each frame is 20 milliseconds long, giving the total update time of 260 ms. This is much faster than the standard gray scale update time, which is 780 ms. The leading diagonal elements contain only 0 V so pixels that do not change between initial and final states do not change optical reflectance, i.e., this is a local update drive scheme. This drive scheme is DC imbalanced, as can be seen by looking at simple closed loops such as 2→1→2; the net impulse applied during this closed loop is +4 frames. The Table below sets out the DC imbalance for single loops for each element of the drive scheme on a per frame basis. A DC balanced transition scheme has a net impulse of zero for any closed loop. It has been found that DC imbalanced driving has a negative impact on display reliability when used continuously and is recommended that DC imbalanced drive schemes be used only occasionally.

TABLE

| | | | | | | | |
|---|---|---|---|---|---|---|---|
| 0 | 2 | 3.5 | 3.5 | 4 | 4 | 4 | 0.5 |
| 2 | 0 | 1 | 1.5 | 0.5 | 1 | 1 | −0.5 |
| 3.5 | 1 | 0 | 0 | 0.5 | 0 | 0.5 | −0.5 |
| 3.5 | 1.5 | 0 | 0 | 0 | 0.5 | 0 | −0.5 |
| 4 | 0.5 | 0.5 | 0 | 0 | 0 | 0.5 | −1 |
| 4 | 1 | 0 | 0.5 | 0 | 0 | 0 | −1 |
| 4 | 1 | 0.5 | 0 | 0.5 | 0 | 0 | −0.5 |
| 0.5 | −0.5 | −0.5 | −0.5 | −1 | −1 | −0.5 | 0 |

FIG. 1 illustrates FT sequences in waveforms [8→5] and [8→6]. In waveform [8→5] an FT sequence of (+−) has been added to the direct impulse sequence of (++). In waveform [8→6] an FT sequence of (−) has been added to (++). The FT sequences reduced gray level errors.

Figure 2:
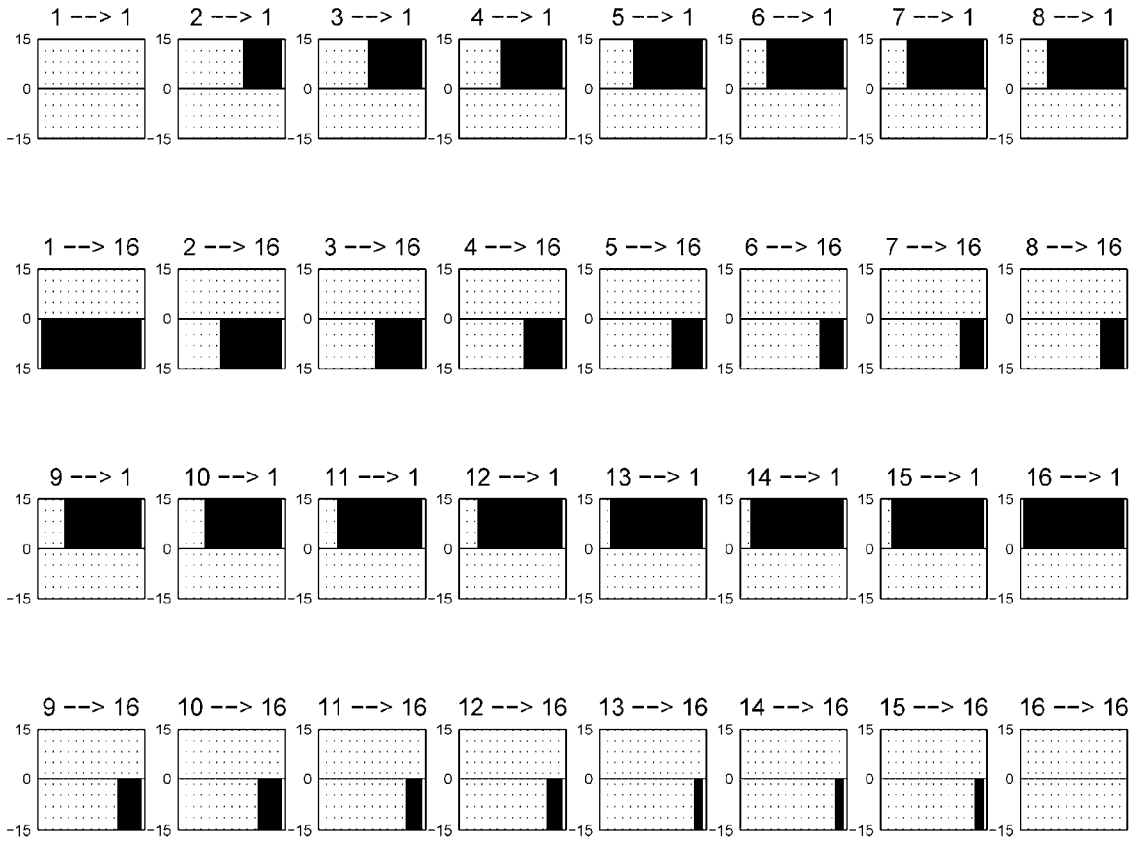
FIG. 2 illustrates the non-zero waveforms of a first 4-bit (16 gray level) direct update drive scheme which can be used in the method of the present invention.
Figure 4:
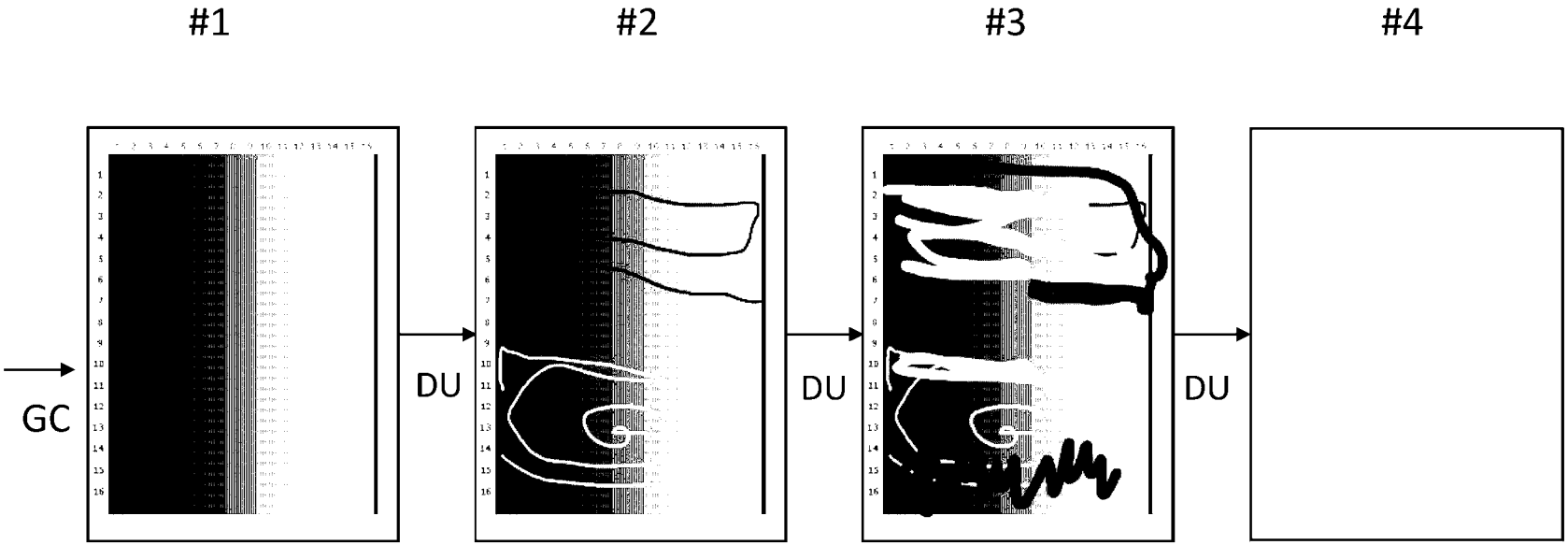
FIG. 4 illustrates a method of the present invention being used to draw black or white lines over an existing gray scale image.

A preferred form of this invention consists of a suite of drive schemes where one is a standard gray scale drive scheme and other is a fast (typically about 260 ms) drive scheme, hereinafter called "direct update" or "DU" drive scheme or mode. It has been found that for a DC balanced drive scheme consisting of a direct impulse structure with FT sequence added to reduce gray tone error to less than 1 L* the longest waveforms are those for transitions between intermediate gray levels (i.e., gray levels other than black and white). The longest waveforms are typically much longer that the saturation pulse. This type of waveform is not desirable for interactive applications. Accordingly, it has been found advantageous to provide drive schemes that only contain transitions from all gray levels (including black and white) to black or white. In such DU drive schemes, all waveforms that do not have a final state of black or white (states 1 and 16 in 4-bit grayscale, states 1 and 8 in 3-bit and states 1 and 4 in 2-bit) consist of only 0 frames, as illustrated in FIG. 2, which shows a 4-bit DU drive scheme created by making, for each transitions ending in black or white, a direct waveform with impulses as defined by the standard gray level drive scheme. The drive scheme shown in FIG. 2 is DC balanced with the standard gray level drive scheme. All waveforms with final state not white or black consist only of 0 V frames. This limits the application of the DU mode to apply to cases where the final states of all pixels are to be black or white. Examples of this including using a touch sensor to draw white or black lines over grayscale images, or mono text input over gray scale images. An illustration of such an application is shown in FIG. 4, where in Sections 2 and 3 white and black lines are written over a gray scale image, and in Section 4, where the whole display is written to white.

Figure 3:
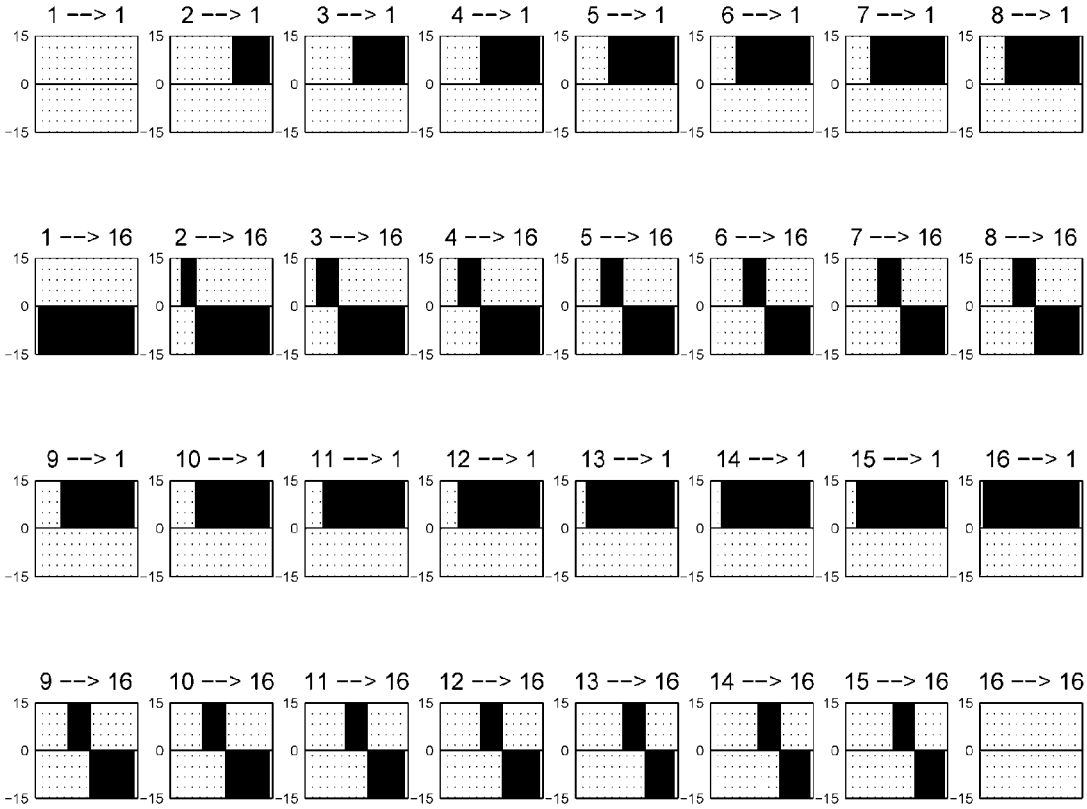
FIG. 3 illustrates the non-zero waveforms of a second 4-bit (16 gray level) direct update drive scheme which can be used in the method of the present invention.
Figure 5B:
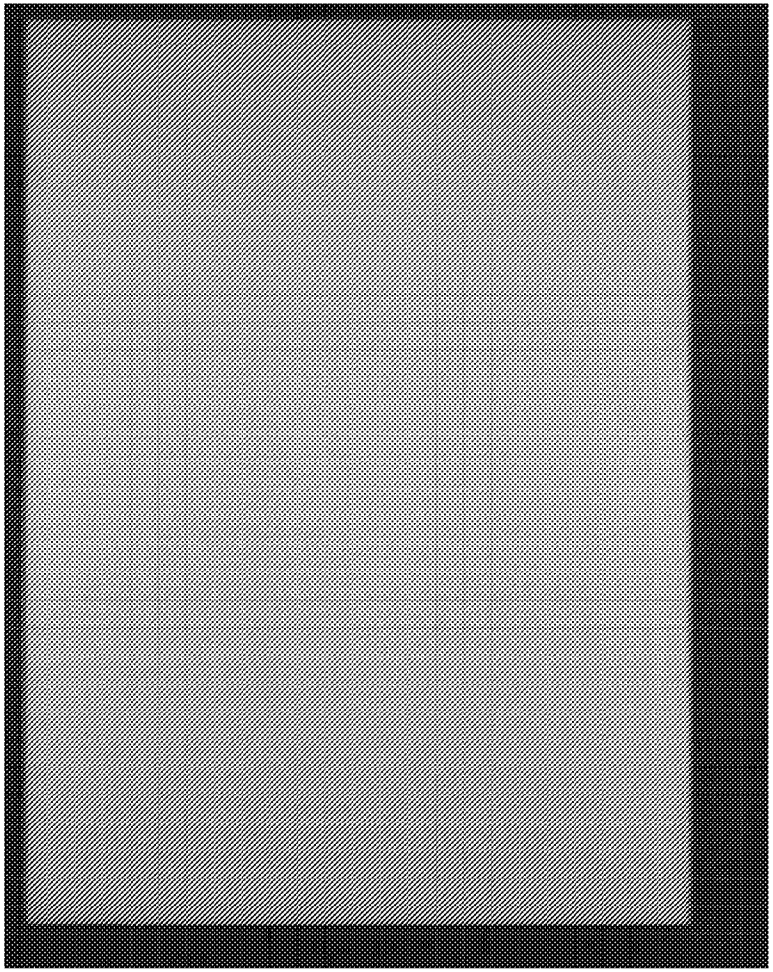
FIGS. 5A and 5B illustrate the improvements in consistency of gray levels which can be achieved by incorporating balanced pulse pairs into a direct update drive scheme of the present invention.
Figure 5A:
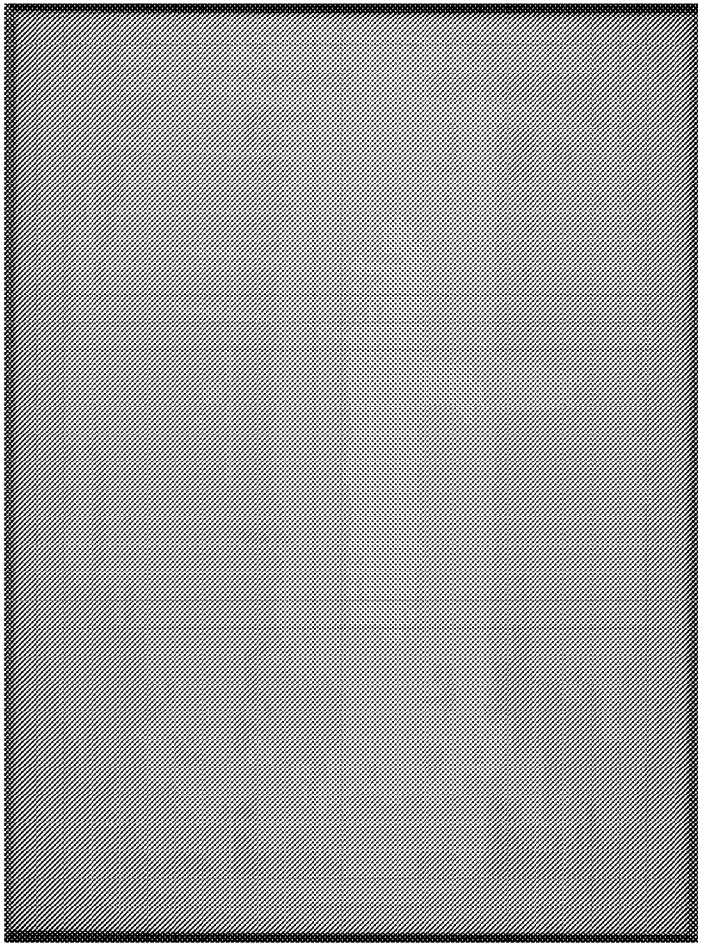

The DU drive scheme may also be varied by adding balanced pulse pairs (i.e., pairs of pulses of equal impulse but opposite polarity, as described in several of the aforementioned MEDEOD applications), for example (+−) or (−+) at the start of the direct impulse. Examples of balanced pulse pairs are (+−, ++−−, +++−−−, etc.). The length of the balance pulse pairs and the direct impulse cannot exceed the length of the saturation pulse. An example of this type of DU drive scheme is shown in FIG. 3. The addition of balanced pulse pairs has been shown to reduce gray level errors while preserving DC balance between the standard gray level drive scheme and the DU drive scheme, as shown in FIGS. 5A and 5B, where the same test as in FIG. 4 has been applied in two cases, and a picture of the display at the end of the test is shown. In FIG. 5A the test was conducted using the DU drive scheme as shown in FIG. 2 and in FIG. 5B the test was conducted using the drive scheme shown in FIG. 3, with reduced gray level error compared with FIG. 5A. The DU drive scheme may also include periods of zero voltage between periods of non-zero voltage.

Figure 6:
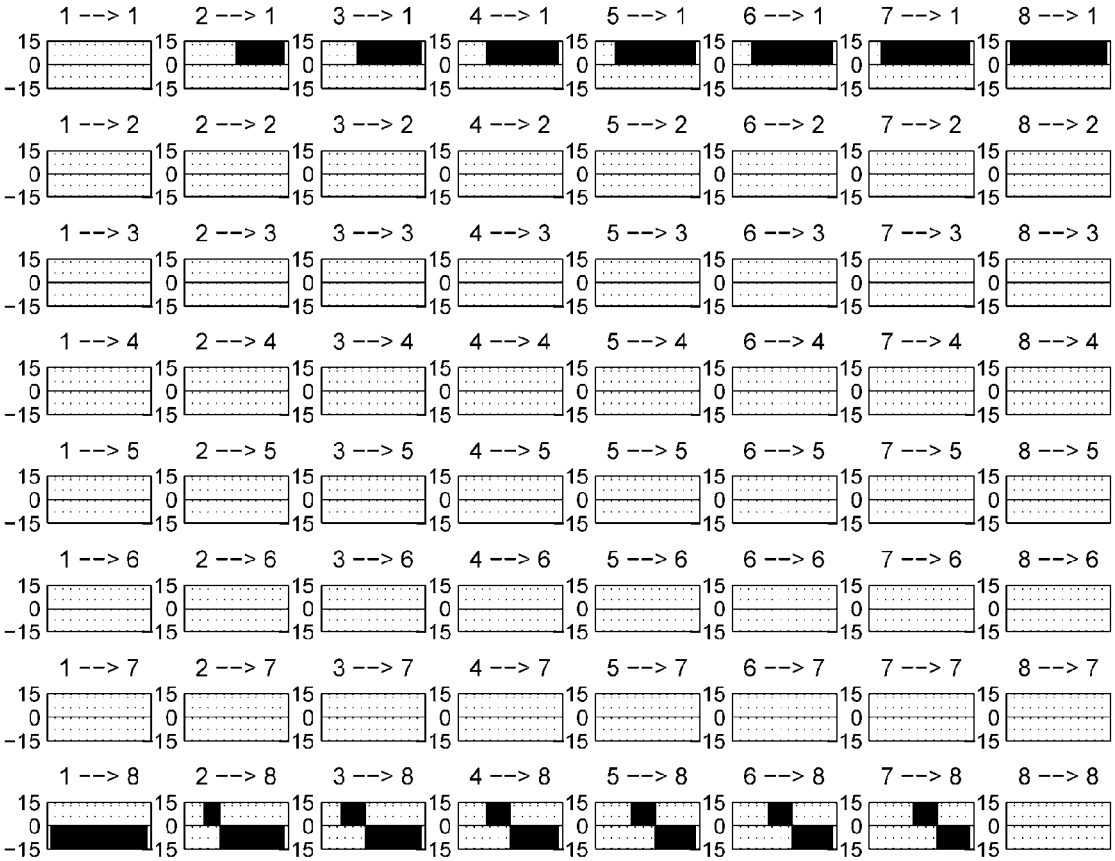
FIG. 6 illustrates the non-zero waveforms of a 3-bit direct update drive scheme which can be used in the method of the present invention.
Figure 7:
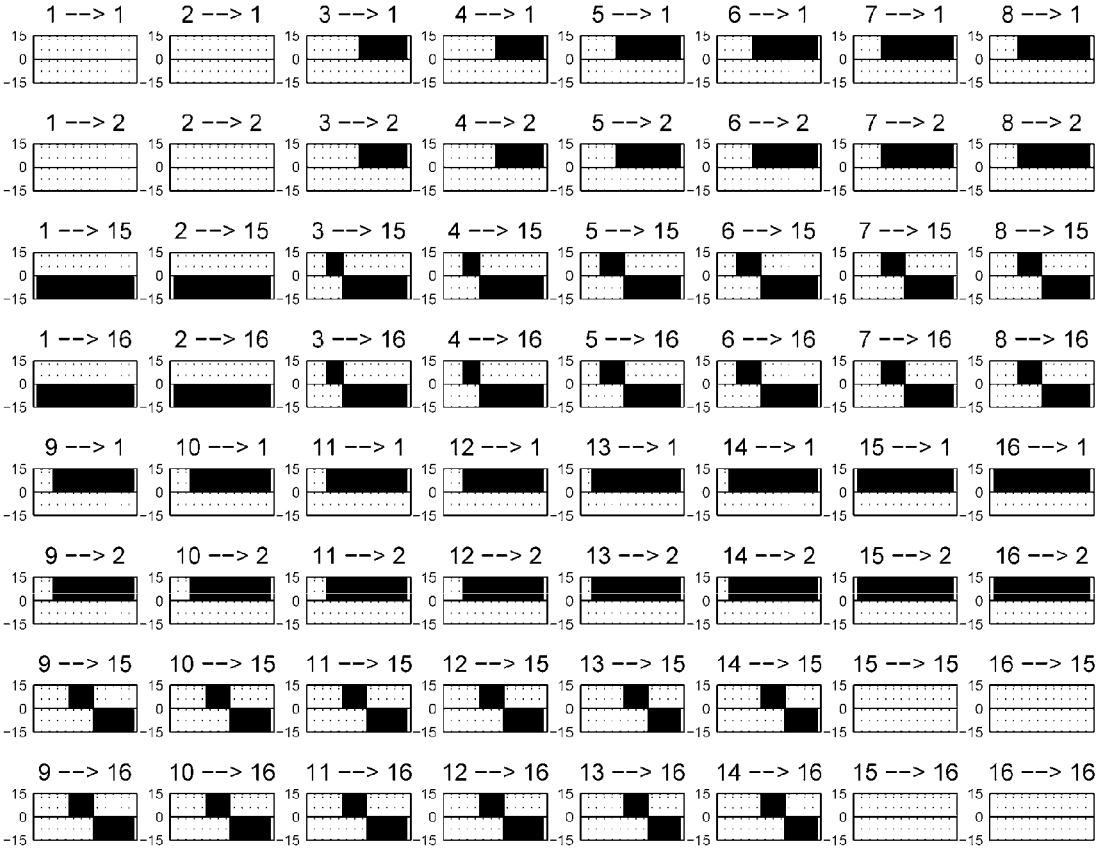
FIG. 7 illustrates a 4-bit projection (as explained below) of the 3-bit drive scheme of FIG. 6.

Since most controllers are designed for 4-bit operation, it has been found advantageous to make 2-bit and 3-bit gray level drive schemes and then project them into a 4-bit representation, as shown in FIGS. 6 and 7. A typical 3-bit DU transition scheme is shown in FIG. 6. For controllers, where the look-up tables are 4-bit in size, we have found it advantageous to fill the 16 state lookup table using the following rule for states 3-bit [1-8] to 4-bit [1-16]: fill states according to [1 2 2 3 3 4 4 5 5 6 6 7 7 8 8], and for 2-bit [1-4] to 4-bit [1-16], fill states according to [1 1 1 1 2 2 2 2 3 3 3 3 4 4 4 4]. An example of such filling for 3-bit is shown in FIG. 7, which shows a 3-bit transition scheme in 4-bit projection.

From the foregoing, it will be seen that the double drive scheme method of the present invention can provide faster updates for electro-optic, and especially electrophoretic, displays, and thus allows device designers to make more interactive applications, thus increasing the usefulness of devices containing such displays.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A method of driving a bistable electro-optic display having a plurality of pixels each of which is capable of displaying at least three optical states, including two extreme optical states, the method comprising:

driving the electro-optic display using a first drive scheme capable of effecting transitions between all of the gray levels which can be displayed by the pixels; and driving the electro-optic display using a second drive scheme which contains only transitions ending at one of the extreme optical states of the pixels.

2. The method according to claim 1 wherein, for each transition of the second drive scheme, a constant voltage is applied for a period sufficient to apply the direct impulse between the initial and final states of the pixel being driven.

3. The method according to claim 1 wherein at least one transition of the second drive scheme incorporates a pair of pulses of equal impulse but opposite polarity.

4. The method according to claim 1 wherein at least one transition of the second drive scheme incorporates a period of zero voltage between two periods of non-zero voltage.

5. The method according to claim 1 wherein the second drive scheme is DC balanced with the first drive scheme.

6. The method according to claim 1 wherein the second drive scheme is used to draw black or white lines or monochrome text input over grayscale images.

7. A display controller or display arranged to carry out the method of claim 1.

8. The display according to claim 7 having a touch sensor.

9. The display according to claim 7 comprising a rotating bichromal member or electrochromic material.

10. The display according to claim 7 comprising an electrophoretic material comprising a plurality of electrically charged particles disposed in a fluid and capable of moving through the fluid under the influence of an electric field.

11. The display according to claim 10 wherein the electrically charged particles and the fluid are confined within a plurality of capsules or microcells.

12. The display according to claim 11 wherein the electrophoretic material comprises a single type of electrophoretic particles in a dyed fluid confined with microcells.

13. The display according to claim 10 wherein the electrically charged particles and the fluid are present as a plurality of discrete droplets surrounded by a continuous phase comprising a polymeric material.

14. The display according to claim 10 wherein the fluid is gaseous.

15. An electronic book reader, portable computer, tablet computer, cellular telephone, smart card, sign, watch, shelf label or flash drive incorporating a display according to claim 7.

16. The method according to claim 1 wherein the second drive scheme comprises transitions from each of the gray levels which can be displayed by the pixels to each of the extreme optical states of the pixels.

* * * * *